US005088423A

United States Patent [19]

Ogura et al.

[11] Patent Number: 5,088,423

[45] Date of Patent: Feb. 18, 1992

[54] BURNER TILE ASSEMBLY

[75] Inventors: Kouji Ogura; Makio Yamaguchi, both of Aichi Pref, Japan

[73] Assignee: NGK Insulators, Ltd., Japan

[21] Appl. No.: 516,918

[22] Filed: Apr. 30, 1990

[30] Foreign Application Priority Data

Apr. 28, 1989 [JP] Japan ..... 1-49616[U]

[51] Int. Cl.[5] ..... F23L 5/00

[52] U.S. Cl. ..... 110/182.5; 110/336; 431/181; 431/187

[58] Field of Search ..... 431/187, 181, 182; 110/182.5, 336

[56] References Cited

U.S. PATENT DOCUMENTS 3,711,243 1/1973 Zink et al. ..... 431/181 X
3,843,317 10/1974 Remmey .
4,004,875 1/1977 Zink et al. .
4,668,180 5/1987 Newman .
4,717,334 1/1988 Hewman ..... 431/187
4,883,422 11/1989 Cristea ..... 431/187 X

FOREIGN PATENT DOCUMENTS 203365 10/1983 Fed. Rep. of Germany .
1433535 2/1966 France .

*Primary Examiner*—Edward G. Favors
*Attorney, Agent, or Firm*—Parkhurst, Wendel & Rossi

[57] ABSTRACT

A high-speed type burner tile assembly including a cylindrical mixing tile having a central through-hole, and a combustion tile having a tip portion aligned with the mixing tile. The tip portion of the combustion tile is coaxially extended into the central cylindrical through-hole of the mixing tile to provide diffusion air delivery passages extending in parallel with the axis of the mixing tile between the tip portion and the inner surface of the through-hole of the mixing tile, thereby permitting the supply of a large volume of diffusion air at low pressures and increasing linearity of the combustion gas supplied into a furnace.

8 Claims, 2 Drawing Sheets

BURNER TILE ASSEMBLY

BACKGROUND OF THE INVENTION

1. Field of the Invention

The present invention relates to a burner tile assembly used in various firing furnaces or the like.

2. Related Art Statement

Hitherto, there has been known a burner tile assembly for use in various firing furnaces as disclosed in Japanese Patent Application Publication No. 80-9603. Such a burner tile assembly, as shown in FIG. 3 illustrating an example thereof, is mainly composed of a high-speed type burner 21; a cylindrical combustion tile 22 aligned with the burner axis for defining a combustion chamber 23 adapted for burning combustible mixed gas injected from the high-speed type burner 21; a plurality of diffusion air nozzles 24 which are arranged around the combustion tile at an angle to the burner axis so as to direct diffusion air supplied under a medium pressure of 500~1000 mm Aq. to the combustion gas out of the combustion chamber; and a mixing tile 25 adapted for mixing the combustion gas from the combustion chamber and the diffusion air from the diffusion air nozzles and for directing the mixture of gases into a firing furnace. The mixing tile 25 is formed as a part of a side wall 26 of the firing furnace so as to support its load by bricks of the side wall 26, but is not integrally formed with the side wall.

In conventional burner tile assembly as mentioned above, however the amount of air which can be supplied is restricted since the diffusion air is supplied by means of a plurality of nozzles and the pressure of air is decreased since the nozzles are inclined at an angle to the burner axis. In order to deliver a lot of air from the diffusion air nozzles 24, it is required to supply the air under a medium pressure as mentioned above. Moreover, the burner tile assembly is not integrally combined and hence the mixing tile 25 must be arranged as a part of the sidewall, but can not be mounted on a fiber side wall having low mechanical strength.

SUMMARY OF THE INVENTION

It is an object of the present invention to overcome the above problems, and to provide a burner tile assembly which is capable of supplying a large amount of air under low pressure and which can be mounted on a side wall having low mechanical strength.

According to the present invention, a high-speed type burner tile assembly comprises a cylindrical mixing tile having a central through-hole, and a combustion tile having a tip portion aligned with the mixing tile. The tip portion of the combustion tile is coaxially extended into the central through-hole of the mixing tile to provide diffusion air delivery passages extending in parallel with the axis of the mixing tile between the tip portion and the inner surface of the through-hole of the mixing tile. It is preferable that the inner surface of the through-hole is cylindrical and that the burner tile and the mixing tile are integrally combined.

According to the above arrangement, it is possible to easily provide diffusion air delivery passages having a larger sectional area than that of the conventional nozzles so that a large volume of diffusion air can be supplied under low pressure, for example 0~500 mm Aq., and to direct the delivered diffusion air parallel to with the flow of combustion gas from the combustion tile so that the linearity of the combustion gas is increased.

By integrally assembling the mixing tile and combustion tile, when the burner tile assembly is provided in the side wall of the firing furnace, all the integrally assembled burner tile can be supported by an outer frame of the furnace body, and hence the burner tile assembly can be attached to a side wall constructed of fiber or other materials having low mechanical strength.

These and other objects, features and advantages of the invention will be appreciated upon reading the following description of the invention when taken in conjunction with the attached drawings, with the understanding that some modifications, variations and changes of the same could be made by the skilled person in the art to which the invention pertains without departing from the spirit of the invention or the scope of claims appended hereto.

DESCRIPTION OF THE PREFERRED EMBODIMENTS

Figure 1:
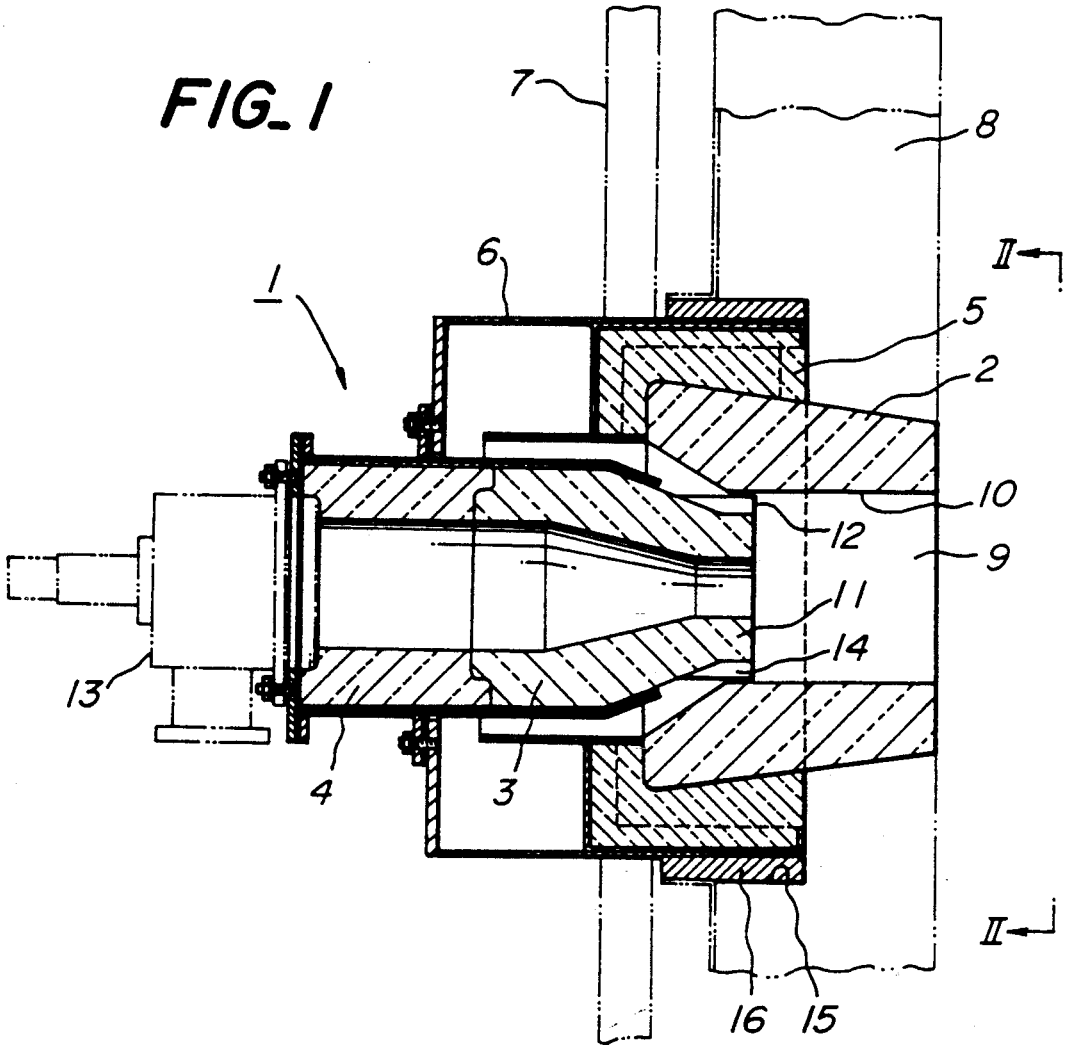
FIG. 1 is a longitudinal sectional view of an embodiment of the high-speed type burner tile assembly according to the present invention.
Figure 2:
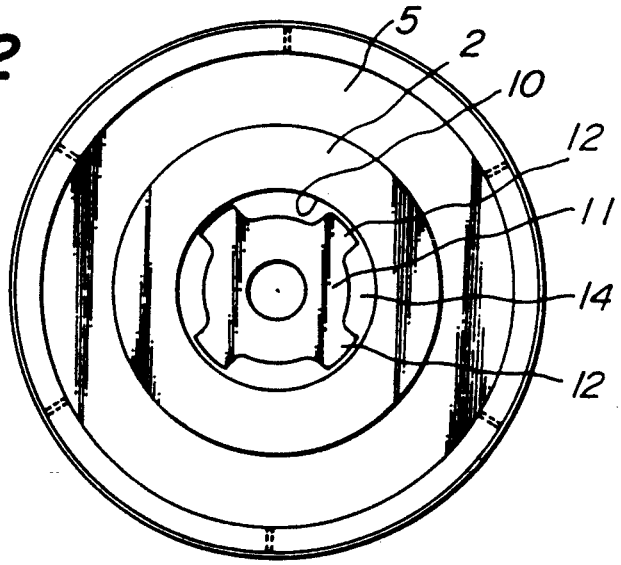
FIG. 2 is a front end view taken on line II—II in FIG. 1.
Figure 3:
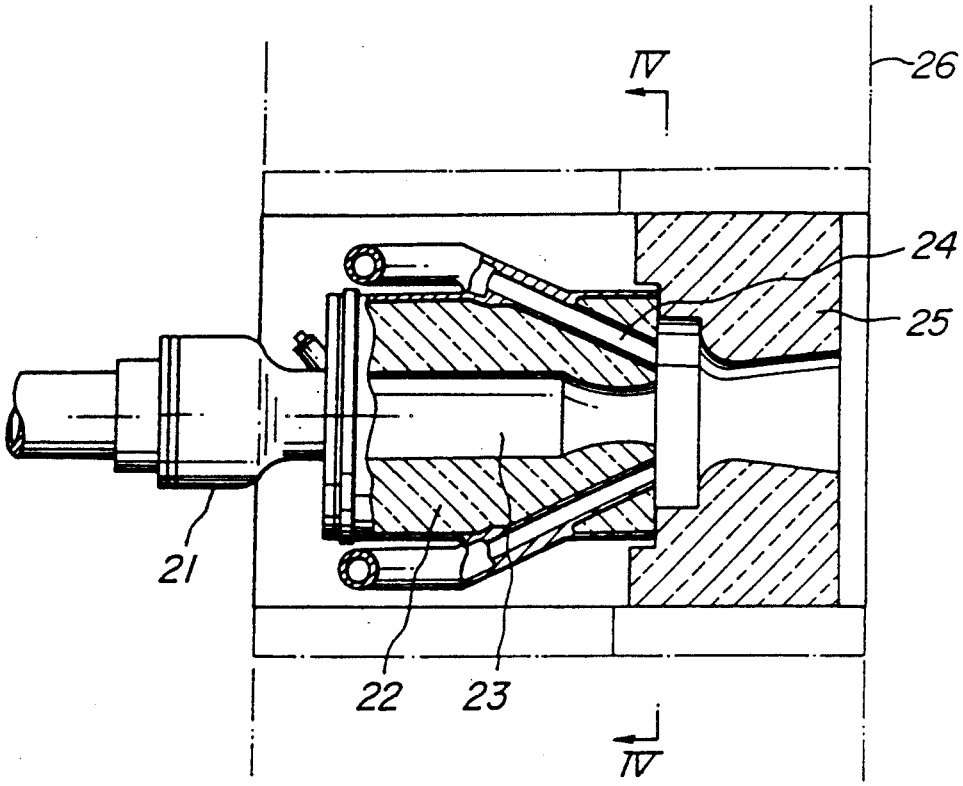
FIG 3 (PRIOR ART)
FIG. 3 is a longitudinal sectional view of a prior art high-speed type burner tile assembly.
Figure 4:
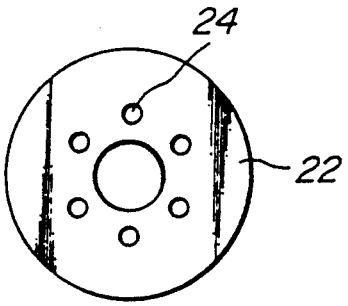
FIG 4 (PRIOR ART)
FIG. 4 is a front end view taken on line IV—IV in FIG. 3.

Referring to FIGS. 1 and 2 illustrating one embodiment of a high-speed type burner tile assembly for use in a firing furnace according to the present invention, a high-speed burner 1 is mainly composed of a cylindrical mixing tile 2 and a combustion tile 3. These tiles 2 and 3 are integrally assembled together with additional tile members 4 and 5 at a predetermined position in a frame 6 which may be supported on an outer frame 7 and/or a side wall 8 of the furnace. The mixing tile 2 has a central through-hole 9 having a cylindrical inner surface 10. The combustion tile 3 has a reduced front end portion or tip portion 11 having a plurality of axial ridges 12 spaced apart circumferentially. The mixing tile 2 and the combustion tile 3 are aligned with a burner 13 and the tip portion 11 of the combustion tile 3 is coaxially extended into the central through-hole 9 of the mixing tile 2 to provide diffusion air delivery passages 14 extending in parallel with the axis of the burner 13 and hence the axis of the mixing tile 2 between the tip portion 11 and the inner surface 10 of the through-hole 9. Each air delivery passage 14 is actually defined by the inner surface 10 and ridges 12 on the outer surface of the tip portion 11.

The burner tile assembly constructed as mentioned above can provide wide diffusion air delivery passages and supply the diffusion air into the furnace in a direction parallel to the common central axis of the burner 21, combustion tile 3 and the mixing tile 2. Moreover, the integrally assembled high-speed type burner tile assembly 1 can be inserted into a hole 15 which is formed in the side wall 8 of the furnace and has a shape corresponding to the shape of the front end portion of the mixing tile 2 and the frame 6 with a seal 16, while the frame 6 is supported on the outer frame 7 of the furnace. Accordingly, the burner tile assembly can be attached to the side wall 9 without any load subjected to the side wall 9.

It should be understood that the present invention is not limited to the aforementioned embodiment and some modifications, variations and changes could be made thereto. For example, the above-described embodiment is provided with four ridges to divide the space between the tip portion of the combustion tile and the inner surface of the mixing tile to provide four diffusion air delivery passages, but the number of the ridges may be changed with same effect. The diffusion air delivery passages are sufficient to extend in parallel with the common central axis at least at the tip portion of the combustion tile, while the other portion of the diffusion air delivery passages may be formed in various shapes.

It is seen from the above description that the high-speed type burner tile assembly of the present invention can provide a wide opening for delivering diffusion air to supply a large volume of diffusion air under low pressure to thereby permit control of the air fuel ratio in a large range of 0.7~7. Moreover, since at least at the tip portion the diffusion air delivery passages extended in parallel with the common central axis of the burner, combustion tile and mixing tile, linearity of the combustion gas can be increased. Furthermore, the burner tile assembly of the present invention can be attached to the side wall of a furnace made of fiber or the other materials having low mechanical strength, because the mixing tile and the combustion tile are integrally combined to provide an integral burner tile assembly which can be substantially supported by a frame arranged outside of the furnace.

What is claimed is:

1. A high-speed type burner tile assembly arranged in a furnace side wall, said assembly comprising a cylindrical mixing tile formed independent of said furnace side wall, said cylindrical mixing tile having a central through-hole, and a combustion tile having a tip portion aligned with the mixing tile, the tip portion of the combustion tile being coaxially extended into the central through-hole of the mixing tile to provide diffusion air delivery passages extending in parallel with an axis of the mixing tile between the tip portion and an inner surface of the through-hole of the mixing tile, wherein combustion occurs within said combustion tile.

2. A high-speed type burner tile assembly claimed in claim 1, wherein the inner surface of the through-hole of the mixing tile is cylindrical.

3. A high-speed type burner tile assembly as claimed in claim 1, wherein the burner tile and the mixing tile are integrally combined.

4. A high-speed type burner tile assembly as claimed in claim 1, further comprising a supporting outer frame.

5. A high-speed type burner tile assembly arranged in a furnace side wall, said assembly comprising a cylindrical mixing tile having a central through-hole defined by an inner surface of said mixing tile, and a combustion tile having a tip portion, said mixing tile being formed independent of said furnace sidewall and integrally connected to said combination tile such that said tip portion is aligned with said mixing tile and coaxially extending into said central through-hole of said mixing tile, thereby defining diffusion air delivery passages between said tip portion of said combustion tile and a portion of said inner surface of said mixing tile, said diffusion air delivery passages extending in parallel with an axis of said mixing tile between said tip portion of said combustion tile and said portion of said inner surface of said through-hole of said mixing tile, wherein combustion occurs within said combustion tile.

6. The assembly of claim 5, wherein said inner surface of said through-hole of said mixing tile is cylindrical.

7. The assembly of claim 5, wherein said mixing tile is integrally combined with a burner.

8. The assembly of claim 5, further comprising a supporting outer frame.

* * * * *